US005578092A

United States Patent [19]

Collin

[11] Patent Number: 5,578,092

[45] Date of Patent: Nov. 26, 1996

[54] METHOD AND A DEVICE FOR PRODUCING FUELS

[76] Inventor: Per Collin, Orrspelsvagen 4, Stocksund S-182 75, Sweden

[21] Appl. No.: 313,105

[22] PCT Filed: Mar. 24, 1993

[86] PCT No.: PCT/SE93/00249

§ 371 Date: Nov. 15, 1994

§ 102(e) Date: Nov. 15, 1994

[87] PCT Pub. No.: WO93/20169

PCT Pub. Date: Oct. 14, 1993

[30] Foreign Application Priority Data

Mar. 30, 1992 [SE] Sweden ..... 9200989

[51] Int. Cl.[6] ..... C10L 5/00

[52] U.S. Cl. ..... 44/620; 44/622; 44/629; 48/197 R; 48/210; 48/212; 48/213

[58] Field of Search ..... 44/620, 629, 622; 48/197 R, 212, 213, 210

[56] References Cited

U.S. PATENT DOCUMENTS

| | | | |
|---|---|---|---|
| 3,970,434 | 7/1976 | Gasior et al. | 44/604 |
| 4,188,191 | 2/1980 | Longanbach et al. | 44/622 |
| 4,315,758 | 2/1982 | Patel et al. | 48/197 R |
| 4,321,233 | 3/1982 | Tsuji et al. | 422/142 |
| 4,338,283 | 7/1982 | Sakamoto et al. | 422/112 |
| 4,407,206 | 10/1983 | Bartok et al. | 48/210 |
| 4,509,957 | 4/1985 | Fiery | 44/605 |
| 4,627,367 | 12/1986 | Butt | 48/210 |
| 4,796,568 | 1/1989 | Pillai | 110/245 |
| 4,823,712 | 4/1989 | Wormer | 110/245 |
| 4,828,486 | 5/1989 | Sakamoto et al. | 422/144 |
| 4,872,886 | 10/1989 | Henley et al. | 48/197 R |
| 4,993,332 | 2/1991 | Boross et al. | 110/245 |
| 5,033,413 | 7/1991 | Zenz et al. | 110/245 |
| 5,069,685 | 12/1991 | Bissett et al. | 48/77 |
| 5,243,922 | 9/1993 | Rehmat et al. | 110/233 |
| 5,306,481 | 4/1994 | Mansour | 48/197 R |

FOREIGN PATENT DOCUMENTS 0144172 6/1985 European Pat. Off. .

*Primary Examiner*—Margaret Medley
*Attorney, Agent, or Firm*—Browdy and Neimark

[57] ABSTRACT

A method for producing fuels based on solid carbonaceous natural fuels which are particularly suited for non-polluting thermal power generation with gas and steam turbines in a combined cycle which is characterized in that the flow of finely-divided natural fuel is pyrolyzed at superatmospheric pressure, suitably 5 to 20 bar, and >700° C. in a cascade of a number of reactors, preferably >3 reactors, and, in that the pyrolysis gas is reformed, preferably in the presence of burnt lime and/or dolomite for desulphuration, is brought into fluidizing contact with the char recirculated from the last reactor in said cascade, with a flow which is >5 times larger than the flow of fuel, the fluidizing contact between the pyrogas formed and the char being continued in the following reactors and the temperature in said reactors preferably being maintained at a level higher than in said first reactor, whereas the temperature in the last reactor in said cascade is suitably maintained at a lower level than in said first reactor, whereas produced "reformed gas" and netto char withdrawn from said last reactor after separation are preferably used as fuel in a combined cycle, whereas the recirculating char withdrawn from said last reactor is after a suitable temperature increase by partial combustion with oxygen containing gas recirculated to said first reactor in said cascade. A device for carrying out said method.

19 Claims, 1 Drawing Sheet

METHOD AND A DEVICE FOR PRODUCING FUELS

In thermo-electric power generation processes the old, established steam turbine cycle is increasingly substituted with a combined cycle comprising gas as well as steam turbine. In this way power generation can be performed with higher efficiency and 45–47% can be reached compared with 39–41% in the steam turbine cycle. Said high efficiency of the combined cycle is, however, obtained only when using natural gas as fuel, and for solid natural fuels, such as coal and bio (biological) fuels the efficiency is restricted to 42–44% because of the complications caused by transforming the fuel to a form which is acceptable for the gas turbine.

A number of processes, such as pressure (super-atmospheric) combustion, complete and partial gasification, etc. have been developed for making possible the use of solid natural fuels in connection with a combined cycle. All said processes are characterized by a high level of complexity and are therefore subjected to operation disturbances in a more than normal degree. This fact and the moderate efficiency of 42–44% have resulted in said processes having not been commonly accepted.

The present invention is directed to an uncomplicated method for transforming solid natural fuels, such as coal, preferably with 5–45% of volatile constituents, lignites, peat and bio fuels, to a form which is suited for a combined cycle, wherein the end product of said method is pressurized clean hot combustable gas with a high heat value, "reformed gas", suited for the gas turbine, and finely-divided hot char with a high heat value, which is suitable as a fuel for all types of steam generators. Char is here intended to be interpreted as the coke-like residue comprising low levels of H, O, N and S, which remains after pyrolysis of solid carbonaceous fuels.

The method according to this invention is characterized by transforming the solid natural fuel to a form suited for the combined cycle by pyrolysis in combination with reformation of the pyro gas in the presence of water vapour, wherein the flow of finely-divided fuel at super-atmospheric pressure, suitably 5–20 bars, and >700° C. in a first reactor in a cascade of reactors, suitably ≧3, in the presence of finely-divided burnt lime and/or dolomite (when "lime" is used in the following in the specification said expression comprises also dolomite) for desulphurization, is brought into fluidizing contact with char recirculated from the last reactor in said cascade with a flow >5 times larger than the flow of fuel, whereafter fluidizing contact between formed pyro gas and char is continued in the subsequent reactors and the temperature in said reactors is suitably maintained at a higher level than in said first reactor, whereas the temperature in the last reactor in said cascade is suitably maintained at a lower level than in said first reactor, whereafter produced pyro gas and net char are separated, and recirculated char discharged from said last reactor, after adapted temperature increase by partial combustion with oxygen containing gas, is recirculated to said first reactor, the pyrolysis reactor, in said cascade.

Figure 1:
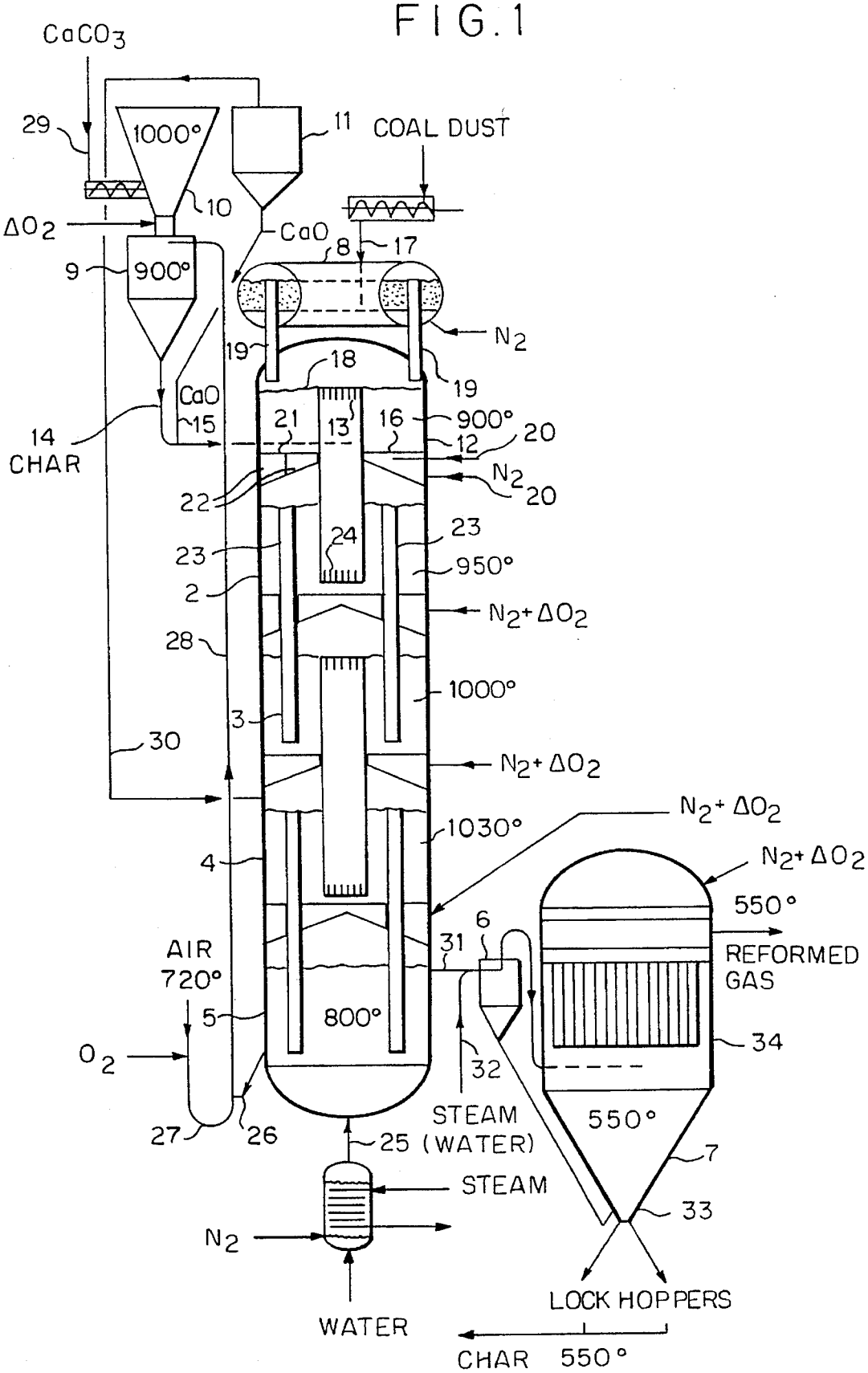
FIG. 1 is a schematic diagram of an embodiment of a device according to present invention.

According to the invention the fluidizing contact between the gas and the char in all the reactors in said cascade is suitably performed in a fluidized bed of classical type, i.e. with the relative void volume $\epsilon$ in the fluidized bed maintained within the range $0.4 < \epsilon < 0.8$. For achieving a good contact and rapid pyrolysis the dried natural fuel is finely-divided prior to the pyrolysis so that suitably 50% thereof has a particle size <150 μm and 90% <250 μm.

The contact of the finely-divided natural fuel and the recirculating char with adapted temperature is performed by blowing the fuel with the aid of inert gas, suitably $N_2$ (when $N_2$ is stated to be the fluidizing gas in the following, said gas can also be substituted with another inert gas) against the surface of the fluidized char bed in the first reactor in said cascade, wherein said char bed is "minifluidized" with inert gas, suitably $N_2$, supplied to the bottom zone of said fluidized bed through distribution means for fluidizing gas arranged there. "Minifluidizing" should be understood as fluidizing with a gas speed in the range $u_{mf} \leqq u \leqq 5\, u_{mf}$, where $u_{mf}$=the minifluidizing speed according to the standard definition.

When brought into contact with the "minifluidized" char bed with a temperature of >700° C., suitably 800°–900° C., the finely-divided fuel is pyrolyzed very rapidly and >90% of its content of volatile constituents are stripped within <1 second. The pyrolysis products consist of tar vapours (tar fumes), vapours (fumes) of light oils, steam and non-condensable gases such as CO, $H_2$, $CH_4$, $C_2H_4$, etc.

Depending upon the content of oxygen in the natural fuel the pyro gas contains more or less of autogenous steam. For natural fuels with a high oxygen content the quantity of steam formed in the pyrolysis is sufficient for the reforming process, but for fuels with a low oxygen content compensation of the shortage by addition of externally produced steam is required. Reforming of the pyrolysis products is according to the invention achieved by bringing said products into a continued fluidized contact with the catalytically very active char for an adapted period of time and at an adapted temperature in the subsequent reactors in said cascade.

Thus, char and pyro gas are transferred in the form of a suspension to the second reactor in said cascade, where the fluidized contact is continued in a fluidized bed of classical type which, however, in this case is "mini-fluidized", suitably with $N_2$ with a small added amount of oxygen containing gas. The combustion reactions taking place hereby with mainly CO as the final product cover the heat demand in the endothermal reforming reactions in said second reactor.

In the following reactors in the cascade the fluidizing contact between the reformed pyro gas and char is according to the invention repeated, wherein the bed temperature is suitably increased from one reactor to the following one. The reformed gas, which leaves the second to last reactor in said cascade in a suspension with char, consists essentially of CO, $H_2$ and $N_2$ and the suspension is fed to the last reactor where "minifluidizing" is performed with $N_2$ with an adapted addition of steam. Said steam reacts with the char forming CO and $H_2$ which causes a decrease of the temperature, suitably to about 800° C., since the reaction is endothermic.

The decrease of the bed temperature in the last reactor in the cascade causes the small remaining amount of tar vapours which optionally may be present in the reformed gas from the second to last reactor to condense on the char and thereby to be made harmless for the filtering process which according to this invention is used for separating the fine-grained fraction of the suspension of net char and reformed gas, which is discharged from the last reactor of said cascade. The coarse fraction is suitably first separated in a hot cyclone prior to the filtering process.

Furthermore, from the bottom zone of the last reactor in the cascade there is a separate discharge of the char which is recirculated to the first reactor (the pyrolysis reactor) after increasing the temperature of said char to the pyrolysis temperature by partial combustion with oxygen containing gas.

Said partial combustion of the recirculating char is according to this invention preferably performed under fluidizing transportation to a hot cyclone arranged at a suitable level, in which hot cyclone the char is separated. After adjustment of the temperature of said combustion gas to 1000°–1200° C. by burning a part of the CO content of said gas with oxygen containing gas, said combustion gas is used for calcination to burnt lime of a flow of finely-divided lime which flow is adapted to the S content of said fuel. The char separated in said hot cyclone is mixed with the burnt lime and the mixture is fed into the fluidized bed in said first reactor in said cascade. In the pyrolysis of the fuel therein about half of the S content of the fuel is transformed into $H_2S$ which is bonded as CaS by the burnt lime present. The rest of the S content of the fuel is present in bonded state in the net char which is separated from the suspension of reformed gas and char which is discharged from the upper part of the last reactor in said cascade. The remaining sulphur in the net char is set free as $SO_2$ when burning the char in connection with the use thereof for generating steam. $SO_2$ is thereby bonded as $CaSO_4$ provided that the addition of CaO is correctly adapted to the recirculating char. By adding burnt lime to the recirculating char in a flow corresponding to a molar ratio Ca/S=1.5–3.0, where S=the content of S in the fuel flow, >90% of the S content of the fuel can be neutralized.

Calcining of the finely-divided lime stone is according to this invention suitably performed in a fluidized bed of venturi type which is directly connected to the hot cyclone in which the recirculating char is separated from the temperature adjusted transportation gas. The separation of the burnt lime (quick lime) in the suspension from the venturi bed is performed in a hot cyclone, from which the gas is fed to the second to last reactor in the cascade, whereby the content of non-combusted CO and the heat content are recovered. The content of carbon dioxide in the gas will then also participate in the cooling of the bed material in the last reactor by reduction of a part of the carbon dioxide to CO, which is a highly endothermal reaction.

When using the net char for generating steam in an ACFB ("atmospheric circulating fluidized bed") a substantial advantage is achieved with the method according to this invention with regard to the content of CaS in the char. The presence thereof in the primary air zone in the ACFB steam generator thus causes decomposition of >70% of $N_2O$ formed therein which is derived from bonded nitrogen in fuel. The decomposition proceeds to $N_2$ and can be illustrated with the following formulas:

| | ΔG kcal |
|---|---|
| $N_2O + \frac{1}{3}CaS + \frac{1}{3}C = \frac{1}{3}CaSO_4 + \frac{1}{3}CO + N_2$ | −71.1 |
| $N_2O + \frac{1}{3}CaS + \frac{1}{3}CO = \frac{1}{3}CaSO_4 + \frac{1}{3}CO_2 + N_2$ | −83.5 |
| $N_2O + \frac{1}{4}CaS = \frac{1}{4}CaSO_4 + N_2$ | −74.5 |

It may be observed that the thermodynamic "driving power" (ΔG) for all reactions is high and about the same under reducing as well as neutral conditions. This means that the lower part of the combustion shaft of the CFB steam generator, at the bottom of which the primary air or about ½ of the flow of combustion air and the char together with CaS from the last reactor in the cascade are introduced, exhibits ideal conditions for decomposition of the nitrous oxide. Reduction of $N_2O$ is highly desirable since nitrous oxide, contrary to NO and $NO_2$, is able to penetrate into the stratosphere where it decomposes under the influence of sunlight and forms free oxygen radicals which, in turn, cause decomposition of the ozone layer.

The suspension of reformed gas and net char discharged from the last reactor in the cascade has a temperature of about 800° C. The main part of the char contained by said suspension is separated in a hot cyclone with simultaneous cooling to <600° C. by mixing the suspension prior to the cyclone with an adapted flow of wet steam and/or finely distributed water. Cooling is suitable for condensing vapours of optional alkali chlorides in the reformed gas, which could damage the gas turbine when using the gas as a gas turbine fuel. The reformed gas leaving the hot cyclone and containing the finest char fraction is thereafter filtered in hot filters of ceramic type, and the separated fine fraction is combined with the char separated in the hot cyclone. The char material obtained is a highly efficient fuel in all types of pressurized (super-atmospheric) as well as atmospheric steam generators.

With the aid of the method according to this invention, >50% of a solid carbonaceous fuel may, in the way described above, be transformed to a hot clean pressurized gas with a high heat value, which is directly suited as a gas turbine fuel, and hot fine-grained char, which is directly suited as a fuel in all types of steam generators. Such stream gene atoms of the ACFB type are preferred since it is thereby possible to achieve a highly environmental-friendly (non-polluting) combined power generation with high efficiency and low emissions of $SO_2$ as well as NO and $N_2O$.

For additional illustration of the invention an embodiment thereof is described with reference to FIG. 1 and based on a bituminous coal with 50% of volatiles and the analysis, etc. stated below:

| % | C | H | O | N | S | ash |
|---|---|---|---|---|---|---|
| | 62.1 | 5.8 | 25.3 | 1.2 | 0.8 | 4.8 |

raw coal, water content = 10%
dry coal, heat value = 6190 kcal/kg waf

The fluidizing contact between the gas and the char in this embodiment takes place in a cascade of five reactors of a classical fluid bed type (1)–(5) which are arranged vertically directly below each other.

The first reactor (1), the pyrolysis reactor, comprises an annular fluid bed chamber (12) with a centrally arranged overflow shaft (13). Recirculated char (14) with an adapted addition of burnt lime (15) and a temperature adjusted to 900° C. is supplied to the fluid bed chamber (12) in the tangential direction and parallel to the bottom (16) thereof, said char flow being adapted so that it is, based on the weight, 10× larger than the flow of coal dust (17) which in suspension with $N_2$ is supplied to the fluid bed surface (18) from the distribution device (8) through an adapted number of evenly distributed injection tubes (19). The fluidized bed in the annular chamber (12) is "minifluidized" with $N_2$ (20), which is supplied to the distribution means (21) through the annular channels (22), making possible different fluidizing gas flows in various bottom zones.

The method of supplying the recirculating char (14) and the "minifluidizing gas" (21) makes it possible to bring the fluid in the annular chamber (12) to macro-rotate in the horizontal as well as vertical directions and thereby to perform a spiral (helical) movement in the annular chamber (12) around the central outlet shaft (13). A larger "minifluidizing gas flow" in the bottom zone close to the outlet shaft (13) causes the fluidized bed material to flow downwards in the outer zone of the annular chamber (12) and upwards in its inner zone, from which the bed material over-flows to the outlet shaft (13).

The injection tubes (19) for the coal dust, which extend up through the bottom of the distribution device (8), which is shaped as an annular classical $N_2$ fluidized fluid bed, in which the injection tubes (19) act as overflows, end in the reactor (1) above the outer zone of the fluid bed surface (18) where the macro-movement of the bed material is directed downwards. The coal dust in the suspension with $N_2$ blows downwards through the injection tubes (19) and hits the fluid bed surface (18) and is rapidly mixed into the char fluid bed, whereby very quick heating and pyrolysis is achieved. Produced pyro gas and char which overflow to the outlet shaft (13) form there together a suspension which is blown down through the shaft.

The reactor (2) is connected directly under the reactor (1), and the outlet shaft (13) thereof ends close to the bottom of the reactor (2). The reactor (2) as well as the reactor (1) are provided with distributing means for "minifluidizing gas" which, however, in this case consists of $N_2$ with an adapted minor addition of air. The char fluid bed in the reactor (2) is maintained at an adapted depth with regard to the desired dwell time of the char therein with the aid of a suitable number of evenly distributed overflow outlet tubes (23) which discharge close to the bottom of the reactor (3).

The suspension of pyro gas and char blowing down through the outlet shaft (13) bubbles up like a plume therearound with violent mixing of the fluid bed material (char) in the reactor (2), whereby a desired fluidizing contact between the catalytically active char and the pyro gas from the reactor (1) is obtained. Thereby reforming of the pyro gas to "reformed gas" is obtained comprising an increase of the content of CO and $H_2$ in the gas with a reduction of the content of tar vapours, vapours of light oils and water therein.

In order to achieve an even distribution around the periphery of the outlet shaft (13) of the pyro gas-char suspension flowing out into the fluid bed of the reactor (2), the wall of the shaft (13) is suitably provided with a number of slots (24). Such slots have proved to be beneficial also in the inlet end of the outlet shaft and around the inlet and outlet ends of the overflow outlet tubes (23).

The char-"reformed gas" suspension blowing down through the overflow outlet tubes (23) to the bottom zone of the reactor (3) directly connected under the reactor (2) bubbles up in the shape of plumes through the fluid bed of catalytically active char in the reactor (3), whereby stripping, pyrolysis and reforming of optional remnants of volatile substances in the char is achieved. For promoting said reactions in the reactor (3) the fluid bed therein is "minifluidized" with $N_2$+an adapted minor flow of air, whereby the temperature is increased by partial combustion, suitably by >30° C.

In the reactor (4) which is connected directly below the reactor (3) the procedure from the reactor (3) is repeated and the temperature in the fluid bed in the reactor (4) is increased, suitably with >30° C., by adding a small air flow to the $N_2$ which is supplied as a "minifluidizing gas". Suitably the temperature increase in the reactors (2), (3) and (4) is adjusted so that the temperature in the reactor (4) can be maintained at about 1000° C.

The suspension of reformed gas and char which blows down through the overflow outlet tubes in the reactor (4) bubbles up through the fluid bed in the reactor (5). Said reactor is "minifluidized" with $N_2$ with an adjusted addition of water vapour which causes a reduction of the bed temperature, suitably to about 800° C., by endothermal reduction of water vapour with char with the formation of CO and $H_2$.

From the last reactor (5) of said cascade recirculating char is discharged (26) from the bottom zone in a flow which, based on the weight, is 10× larger than the flow of coal (17). With the aid of preheated, optionally oxygen enriched air (27) the char is transported (28), with simultaneous partial combustion and temperature increase to the pyrolysis temperature (900° C.), to the hot cyclone (9) where the char is separated and, after mixing with burnt lime (15), is fed to the pyrolysis reactor (1).

The hot cyclone (9) is directly connected to the venturi fluid bed reactor (10) where calcining of finely-divided limestone (29) is carried out by bringing it into fluidizing contact with the transport gas from the cyclone (9), the temperature of which is adjusted to 1000°–1200° C. Said temperature adjustment is performed by adding to the transport gas an adjusted flow of $O_2$ (air) with which a part of the CO content of the transport gas is combusted.

The suspension of burnt lime and transport gas which leaves the venturi reactor (10) is blown directly into the hot cyclone (11), from which separated burnt lime is fed to the flow of char from the cyclone (9). The hot gas leaving the cyclone (11) and which in addition to $CO_2$ and $N_2$ contains also non-combusted CO is according to this invention used by being fed (30) to the reactor (4) where it is mixed with the suspension of char and reformed gas blowing down through the overflow outlet tubes to the bottom zone of the fluid bed of char in the reactor (5).

The suspension of net char and "reformed gas" produced is discharged from the reactor (5) at the level of the surface of the fluid bed and is blown through the conduit (31) to the hot cyclone (6). In said conduit (31) an adjusted flow of wet water vapour (32) is added for cooling down the suspension to <600° C., whereby optional vapours of alkali chlorides are brought to condense.

In the hot cyclone (6) net production of char with particles with particle size >about 10 μm is separated and fed to the outlet part (33) of the filter unit (7) whereas the "reformed gas" with the smallest particles is fed to the filter part (34) of the filter unit. This consists of vertical tubes of porous ceramic material with a bottom, on which tubes the finest char particles build up a layer which acts as the true filter material. By periodic "back blowing" of said filter tubes clogging of said filter tubes is prevented and knocked-off char material falls down in the outlet part (33) of the filter unit where the material separated by the filter is combined with the coarser char fraction from the cyclone (6). From the filter unit (7) the char is fed to closed "lock hoppers" which are alternatingly subjected to pressure relief and make possible the use of the char as a fuel also in atmospheric steam generators of all kinds.

The reactors (1)–(5) are according to this invention of such dimensions that the total dwell time of the net char flow amounts to >5 seconds, suitably 10–100 seconds. The higher the temperature maintained in the reactors in said cascade is, the shorter is the dwell time required for complete stripping of the volatile substances of the fuel and complete reforming of the vapours of tars and light oils in the pyro gas. At a high temperature also a part of the active fine fraction of the char is gasified by reaction with water vapour.

The method according to this invention produces per kg of coal waf of the gas flame coal mentioned above, net char and "reformed gas" from the last reactor in the cascade with the following yields, analyses and characteristics:

| 1.51 $Nm^3$ "reformed gas", 800° C. and 15 bars | | | | |
|---|---|---|---|---|
| analysis | CO | $CO_2$ | $H_2$ | $N_2$ |
| % | 30.5 | 7.8 | 43.5 | 18.2 |
| heat value = 2050 kcal/$Nm^3$ (Hu) | | | | |

| 0.33 kg char waf, 800° C. | | | | | | |
|---|---|---|---|---|---|---|
| analysis | C | H | O | N | S | ashes |
| % | 81.6 | 0.6 | 1.3 | 1.3 | 0.7 | 14.5 |
| heat value = 7990 kcal/kg waf (Hu) | | | | | | |

The solid coal fuel is thus, by the method according to this invention, divided into, on one hand, gas with a high heat value corresponding to 56.3%, and on the other hand, fine-grained and thereby easily combusted char with likewise a high heat value corresponding to 43.7% of the energy content of the coal.

A fuel with a high content of volatile substances gives the best result in the method according to this invention. Thus, as regards for instance (black) coal (mineral coal), coal with 35–45% of volatiles (gas flame coal and flame coal) are preferred since these materials give the highest yield of "reformed gas". A way to improve the possible uses of (black) coal with a lower content of volatiles is to compensate the lack of volatile material with oil. This oil is according to this invention added to the pyrolysis reactor (1), suitably by being sprayed on the surface of the fluid bed or onto char which overflows and falls down into the outlet shaft (13) of the reactor. Economically important is that by this invention it is possible to use cheap sulphur and vanadium containing residual oils, which today do not have a market for the main part of power generating methods. Thus, sulphur as well as vanadium are captured as sulphate and vanadate resp. in the combustion of char produced according to this invention because of the content of burnt lime therein.

A plant for carrying out the method according to this invention, for which also patent protection is sought, comprises the following main parts, of which, however, the embodiments may vary within comparatively broad limits without deviating from the scope of invention:

a number of fluid bed reactors (1)–(5) with corresponding distribution chamber for "minifluidizing gas" arranged in a cascade below each other in a common pressure supporting cylindrical shell, where all reactors, besides the lowest, are provided with overflow outlets for transferring char and gas in the form of a suspension to the underneath reactor;

a pressurized distribution means (8) with flow controlling feeder for finely-divided fuel and with a chamber for fluidizing gas and overflow outlet for a suspension of fuel and gas discharging in the first reactor (1) of the cascade;

a separating and filtering unit (6)+(7) for separating char and "reformed gas" in the suspension from the last reactor in the cascade;

a "pipe-lift" including hot cyclone (28)+(9) for recirculation of char from the last to the first reactor in the cascade with simultaneous partial combustion thereof;

and optionally a venturi reactor (10) with flow controlling feeder directly connected to the "pipe-lift" cyclone (9) and to the cyclone (11) for burnt lime and/or dolomite.

I claim:

1. A method of producing fuels for environmentally friendly thermal power generation with gas and steam turbines in combined cycle from solid carbonaceous natural fuels, comprising the steps of:

introducing a flow of finely-divided solid carbonaceous natural fuel and a separate flow of char formed from pyrolysis of solid carbonaceous fuel and mixed with a flow of burnt lime, dolomite, or a mixture of burnt lime and dolomite to a first reactor in a cascade of at least three reactors at super-atmospheric pressure and at a temperature above 700° C., wherein the flow of char is at least five times greater than the flow of the solid carbonaceous natural fuel;

fluidizing the char in the first reactor to form a fluidized bed of char;

contacting the finely-divided solid carbonaceous natural fuel with the fluidized bed of char in the first reactor at a temperature above 700° C. to pyrolyze the solid carbonaceous natural fuel and form a pyro gas;

reforming the pyro gas by fluidized contact with fluidized char as the reforming pyro gas and fluidized char progress through the cascade of at least three reactors to form a reformed gas and net char, wherein the fluidized char forms a fluidized bed of char in each of the reactors in the cascade, wherein the temperature in the last reactor in the cascade of at least three reactors is maintained at a level lower than the temperature in the first reactor, and wherein, with the exception of the last reactor, the temperature in each of the least three reactors in the cascade is maintained at a level higher than the previous reactor in the cascade;

recirculating char from the last reactor to the first reactor in the cascade of at least three reactors with the addition of oxygen-containing transport gas and raising the temperature of the recirculating char by partial combustion;

discharging the resulting reformed gas and net char in suspension from the last reactor; and separating the reformed gas and net char, wherein the separated reformed gas and net char are suitable for use as fuels in a gas and steam turbine combined cycle thermal power generation.

2. The method in accordance with claim 1, wherein:

the fluidized contact between pyro gas and fluidized char in the reactors of the cascade is carried out in fluidized beds of char formed in each of the reactors of the cascade of at least three reactors and having a relative void volume $\epsilon$ between 0.4 and 0.8; and the fluidized beds of char are fluidized with an inert gas having a gas speed in the range of $\mu_{mf}$ to 5 $\mu_{mf}$, where $\mu_{mf}$ is the minifluidizing gas speed.

3. The method in accordance with claim 2, wherein:

the inert gas generates helical movement of the fluidized bed of char in the first reactor of the cascade;

the fluidized bed of char in the last reactor is fluidized with water vapor in combination with the inert gas to lower the temperature in the last reactor of the cascade; and the fluidized bed of char in each reactor intermediate to the first and the last reactor of the cascade is fluidized with air or oxygen in combination with the inert gas to raise the temperature in each intermediate reactor.

4. The method in accordance with claim 2, wherein the inert gas is $N_2$.

5. The method in accordance with claim 1, wherein the net char discharged from the last reactor in the cascade has a total dwell time greater than five seconds in the fluidized beds of char in the cascade of at least three reactors.

6. The method in accordance with claim 5, wherein the total dwell time is in the range of about 10 to 100 seconds.

7. The method in accordance with claim 1, further comprising the step of cooling the discharged reformed gas and net char in suspension from the last reactor in the cascade to a temperature less than 600° C. by the addition of wet water vapor, finely-divided water, or a mixture thereof.

8. The method in accordance with claim 1, wherein the step of separating the reformed gas and the net char is carried out with a hot cyclone and a ceramic high temperature filter in a hot cyclone.

9. The method in accordance with claim 1, further comprising the steps of:

separating the recirculating char from the transport gas;

subsequently adjusting the temperature of the transport gas to 1000°–1200° C.;

calcining finely-divided limestone, dolomite, or a mixture thereof by contacting with transport gas to form a suspension of burnt lime, dolomite, or a mixture thereof, in transport gas;

separating burnt lime, dolomite or a mixture thereof from the transport gas; and mixing burnt lime, dolomite, or a mixture thereof with recirculating char before introducing the mixture to the first reactor in the cascade of at least three reactors so as to desulfurize the solid carbonaceous natural fuel or products derived therefrom.

10. The method in accordance with claim 9, wherein said calcining step is carried out in a venturi fluid bed reactor.

11. The method in accordance with claim 9, wherein said step of separating burnt lime, dolomite, or a mixture thereof from the transport gas is carried out in a hot cyclone.

12. The method in accordance with claim 1, wherein the solid carbonaceous natural fuel is selected from the group consisting of black coal, mineral coal, gas flame coal, flame coal, and coals with 35–45% of volatiles.

13. The method in accordance with claim 1, wherein the solid carbonaceous natural fuel in said introducing step has a low content or shortage of volatile materials, and wherein said introducing step further comprises introducing a residual oil to the first reactor in the cascade of at least three reactors to compensate for the shortage of volatile materials in the solid carbonaceous natural fuel.

14. The method in accordance with claim 13, wherein the residual oil is introduced by spraying on the surface of fluidized char.

15. The method in accordance with claim 13, wherein the residual oil is selected from the group of sulfur-containing or vanadium-containing residual oils.

16. The method in accordance with claim 1, wherein the super-atmospheric pressure in the first reactor in a cascade is in the range of about 5 to 20 bars.

17. A device for carrying out the method of claim 1, comprising:

a cylindrical pressure supporting shell having a top end, a bottom end and an interior, said interior being subdivided along the longitudinal axis of said cylindrical pressure supporting shell into at least three adjacent fluid bed reactors, each with distribution chambers for fluidizing gas, said at least three adjacent fluid bed reactors are arranged in a cascade, wherein a first fluid bed reactor of said at least three adjacent fluid bed reactors is disposed at said top end of said cylindrical pressure supporting shell and a last fluid bed reactor of said at least three adjacent fluid bed reactors is disposed at said bottom end of said cylindrical pressure supporting shell, and wherein adjacent fluid bed reactors are connected by an overflow outlet tube for transferring gas and char in suspension from one adjacent fluid bed reactor to another;

pressurized distribution means having a chamber for fluidizing finely-divided solid fuel with a fluidizing gas into a suspension and a flow controllable feeder for introducing finely-divided solid fuel into said chamber, said chamber having at least one overflow outlet tube for discharging the suspension of finely-divided solid fuel in fluidizing gas into said first fluid bed reactor of said at least three adjacent fluid bed reactors;

a separation and filtering means connected to said last fluid bed reactor of said at least three adjacent fluid bed reactors, said separation and filtering means separates the reformed gas and the char in suspension being discharged from said last fluid bed reactor of said at least three adjacent fluid bed reactors; and a recirculating means for recirculating char from said last fluid bed reactor to said first fluid bed reactor of said at least three adjacent fluid bed reactors.

18. A device in accordance with claim 17, wherein said recirculating means comprises:

a cyclone connected to said first fluid bed reactor to introduce recirculating char; and a pipe-lift having an inlet and an outlet for transporting recirculating char from said last fluid bed reactor to said cyclone.

19. A device in accordance with claim 18, further comprising;

a venturi fluid bed reactor directly connected to said cyclone and having a flow controllable feeder; and a second cyclone for separating a discharged suspension from said venturi fluid bed reactor, said second cyclone discharging into said first fluid bed reactor.

* * * * *